US007240974B2

(12) United States Patent
Hirtsiefer

(10) Patent No.: US 7,240,974 B2
(45) Date of Patent: Jul. 10, 2007

(54) FOLDING COVER

(75) Inventor: Artur Hirtsiefer, Neunkirchen-Seescheid (DE)

(73) Assignee: Huwil-Werke GmbH, Ruppichteroth (DE)

( * ) Notice: Subject to any disclaimer, the term of this patent is extended or adjusted under 35 U.S.C. 154(b) by 358 days.

(21) Appl. No.: 10/489,667

(22) PCT Filed: Jul. 13, 2002

(86) PCT No.: PCT/EP02/07817

§ 371 (c)(1),
(2), (4) Date: Mar. 16, 2004

(87) PCT Pub. No.: WO03/025323

PCT Pub. Date: Mar. 27, 2003

(65) Prior Publication Data

US 2004/0239213 A1 Dec. 2, 2004

(30) Foreign Application Priority Data

Sep. 17, 2001 (DE) ..... 101 45 856

(51) Int. Cl.
*E05F 1/10* (2006.01)
*E05D 15/26* (2006.01)

(52) U.S. Cl. ..... 312/109; 312/327; 312/319.2; 312/276

(58) Field of Classification Search ..... 312/109, 312/326, 327, 328, 329, 271, 275, 276, 319.2, 312/319.1, 319.4, 325, 322; 16/325, 327, 16/331, 286, 322; 49/386, 387
See application file for complete search history.

(56) References Cited

U.S. PATENT DOCUMENTS 472,483 A * 4/1892 Loomis ..... 16/327
2,483,947 A 10/1949 Alonzo
2,656,563 A * 10/1953 Rees ..... 16/327
4,981,348 A * 1/1991 Prillard ..... 359/844

(Continued)

FOREIGN PATENT DOCUMENTS

DE 1529652 B * 1/1970

(Continued)

*Primary Examiner*—Janet M. Wilkens
*Assistant Examiner*—Timothy M. Ayres
(74) *Attorney, Agent, or Firm*—Sughrue Mion, PLLC

(57) ABSTRACT

A folding lid for a cabinet. The folding lid or cover (8) can be displaced between an opened position and a closed position. The folding cover includes a first cover element (9) which can be fastened to a cupboard cover (2) in a manner that permits it to pivot around a horizontally arranged first axis (10); a second cover element (11) which is joined to the first cover element (9) in a manner that permits it to pivot around a horizontally arranged second axis (12); and a cover positioner (14) with a positioning arm (13), which can be fastened to a side wall (3) in a manner that permits it to pivot around a horizontally arranged third axis (15) and which is joined to the second cover element (11) in a manner that permits it to pivot around a horizontally arranged fourth axis (16), whereby the distance between the first axis (10) and the second axis (12) is greater than the distance between the second axis (12) and the fourth axis (16) and is greater than the distance between the second axis (12) and a lower edge (52) of the second cover element (11).

12 Claims, 4 Drawing Sheets

U.S. PATENT DOCUMENTS

| | | | | | |
|---|---|---|---|---|---|
| 5,513,420 | A | * | 5/1996 | Kennedy | 16/289 |
| 5,530,993 | A | * | 7/1996 | Hayakawa | 16/332 |
| 5,882,099 | A | * | 3/1999 | Salice | 312/328 |
| 5,971,514 | A | * | 10/1999 | Hayakawa | 312/319.2 |
| 6,332,660 | B1 | * | 12/2001 | Salice | 312/328 |
| 6,463,627 | B1 | * | 10/2002 | Hirtsiefer | 16/286 |
| 6,877,830 | B2 | * | 4/2005 | Salice | 312/327 |
| 2002/0108311 | A1 | | 8/2002 | Salice | |

FOREIGN PATENT DOCUMENTS

| | | | | |
|---|---|---|---|---|
| DE | 2516635 | B | * | 4/1976 |
| DE | 201 00 662 | U | | 4/2001 |
| EP | 1 055 381 | A | | 11/2000 |
| FR | 2089842 | A | * | 1/1972 |

* cited by examiner

FOLDING COVER

BACKGROUND OF THE INVENTION

The invention relates to a folding lid for a cabinet, more particularly for an overhead cabinet for a kitchen, wherein the folding lid is arranged so as to open upwardly and, for the purpose of closing a body of the cabinet, is settable between an open position and a closed position. The folding lid comprises a first lid element which can be fixed to an upper cabinet shelf of the body so as to be pivotable around a horizontally arranged first axis. Furthermore, the folding lid comprises a second lid element which is connected to the first lid element so as to be pivotable around a horizontally arranged second axis. In the closed position of the folding lid, the lid elements are arranged one above the other. When transferring the folding lid into the open position, the first lid element is pivoted upwardly away from the body, with the second lid element also being pivoted upwardly towards the body, so that the folding lid is folded together.

DE 201 00 662 shows such a folding lid which, in its open position, is held in this position by a lid setting element. The lid stay comprises a lever which, near an upper cabinet shelf of the body, is pivotably secured to a side wall of the body. A first arm of the lever is pivotably secured to the second lid element near a joint between the first lid element and the second lid element. A second arm arranged approximately at a right angle relative to the first arm is articulatably connected to a pressure spring element which is supported against the body. In the closed position of the folding lid, the lever is force-loaded by means of the pressure spring element in such a way that there is generated a torque which loads the folding lid towards its closed position. When transferring the folding lid from the closed position towards the open position, there is passed a dead center, so that from an intermediate position of the folding lid onwards, the latter is loaded by the pressure spring element into the open position. In the open position of the folding lid, there is passed an upper dead center, so that the folding lid cannot drop from the open position into the closed position. Because the first arm of the lever is articulated near the upper edge of the second lid element, i.e. near the joint axis of the joint between the first lid element and the second lid element, there has to be arranged a handle for opening the folding lid again near the upper edge of the second lid element. This is necessary to be able to lift the lid from the body. However, in the open position of the folding lid, the handle is in a very elevated position, so that it is difficult for users to reach same. Furthermore, the folding lid is not held in every intermediate position of the folding lid between the open position and the closed position.

SUMMARY OF THE INVENTION

It is the object of the present invention to provide a folding lid wherein there are provided articulation means between the lid elements and the lid stay and wherein a handle for opening and closing the folding lid can be provided as closely as possible near the lower edge of the lower lid element, which articulation means make it possible to include means which are able to hold the folding lid in every position.

The objective is achieved by providing a folding lid for a cabinet, more particularly an overhead cabinet, e.g. for kitchen or office furniture, which is arranged so as to open upwardly and which can be set between an open position and a closed position, comprising a first lid element which can be fixed at an upper cabinet shelf of the body so as to be pivotable around a horizontally arranged first axis;

a second lid element which is connected to the first lid element so as to be pivotable around a second axis extending parallel to the first axis;

a lid stay with a setting arm which is fixed to a side wall of the body so as to be pivotable around a third axis extending parallel to the first axis and which is connected to the second lid element so as to be pivotable around a fourth axis extending parallel to the first axis, wherein the distance between the first axis and the second axis is greater than the distance between the second axis and the fourth axis as well as greater than the distance between the second axis and the lower edge of the second lid element, which lower edge is arranged remote from the first lid element.

As the distance between the first axis, i.e. the joint between the first lid element and the upper cabinet shelf, and the second axis, i.e. the joint between the first lid element and the second lid element, is greater than the distance between the second axis and the fourth axis, i.e. the joint between the setting arm and the second lid element, it is ensured that the folding lid is folded together in its open position. In the open position, the first lid element assumes a position in which the plane of the first lid element encloses only a small angle relative to the horizontal plane, so that the lower edge of the first lid element does not project too much upwardly beyond the upper cabinet shelf. It is thus possible to use the folding lid for cabinets which are fitted at a very high level and near the ceiling of a room. Furthermore, the claimed conditions between the distances ensure that the second lid element can be folded upwardly towards the first lid element, so that the plane of the first lid element and the plane of the second lid element enclose an acute angle relative to one another. The lower edge of the second lid element is arranged as far towards the top as possible and near the body, so that there is achieved a large aperture for reaching into the interior of the cabinet.

As it is proposed that the distance between the first axis and the second axis is also greater than the distance between the second axis and the lower ledge of the second lid element, it is ensured that the setting arm can be mounted near the lower edge of the second lid element. A handle for opening the folding lid—if viewed in the closed position of the folding lid—has to be arranged at the level of the point of articulation of the folding lid at the second lid element or beyond same, so that the folding lid can be opened. If the handle is arranged below the point of articulation of the setting arm, there is generated a torque which acts on the second lid element and is arranged around the fourth axis, so that, in the region of abutment between the first lid element and the second lid element, the folding lid cannot be lifted off the body.

Furthermore, the way in which the axes are arranged ensures that the third axis, i.e. the articulation point of the setting arm at the side wall of the body, can be arranged above an imaginary horizontal central plane of the body. The setting arm is not arranged in the region of an inserted shelf of the cabinet. As a rule, the shelves are inserted in the center of the cabinet, i.e. at the level of the central plane of the body.

Furthermore, said folding lid makes it possible to provide elements at the lid stay by means of which the setting arm can be torque-loaded at least via part of the pivot path from the closed position to the open position of the folding lid towards the open position and for the magnitude of the torque in each pivot position of the folding lid to be such that the folding lid is held in place. This means that the folding lid can also be held in every intermediate position between the open position and the closed position. The folding lid thus does not have to be transferred into the upper open position for it to be held in place. The folding lid can be transferred by any user into an uppermost position which can be reached by such a person, which uppermost position does not necessarily correspond to the upper open position, and it is always ensured that the folding lid is held in place.

Furthermore, the objective is achieved by providing a folding lid for a cabinet, more particularly an overhead cabinet, e.g. for kitchen or office furniture, which is arranged so as to open upwardly and which can be set between an open position and a closed position, comprising

- a first lid element which can be fixed at an upper cabinet shelf of the body so as to be pivotable around a horizontally arranged first axis;
- a second lid element which is connected to the first lid element so as to be pivotable around a second axis extending parallel to the first axis;
- a lid stay with a setting arm which is fixed to a side wall of the body so as to be pivotable around a third axis extending parallel to the first axis and which is connected to the second lid element so as to be pivotable around a fourth axis extending parallel to the first axis,
- wherein the lid stay comprises means via which the setting arm can be torque-loaded towards the open position along at least a part of the pivot path from the closed position to the open position of the folding lid wherein the magnitude of the torque in each pivot position of the folding lid is such that the folding lid is held.

Preferably it is proposed that the distance between the first axis and the second axis is greater than the distance between the second axis and the fourth axis and that, in the closed position of the folding lid, the third axis is arranged above an imaginary horizontal central axis of the folding lid.

Furthermore, the distance between the first axis and the second axis can be greater than the distance between the second axis and the lower edge of the second lid element, which lower edge is arranged so as to be remote from the first lid element.

In a preferred embodiment it is proposed that in the open position of the folding lid, the fourth axis is arranged so as to be offset towards the first lid element relative to a plane containing the second axis and the third axis. As a result, the second lid element and the setting arm are in an aligned position when the folding lid is in the open position. The imaginary connecting lines between the second axis and the fourth axis and between the third axis and the fourth axis can, approximately, be arranged on a straight line, but preferably they should form an obtuse angle relative to one another in the case of which the upper dead center is passed. This means that the force of the weight of the two lid elements causes the setting arm to be loaded further upwardly and that the second lid element is loaded towards the first lid element, so that the folding lid cannot move automatically from the open position into the closed position. Said angular position which only slightly deviates from a straight line is regarded as the aligned position in the sense of the invention.

According to a preferred embodiment of the folding lid, it is proposed that the first lid element comprises a first panel and that the second lid element comprises a second panel, wherein the first panel and the second panel comprise identical heights if viewed in the closed position of the folding lid; that there is provided at least one hinge arm which is secured to an inner face of the first lid element, which inner face is directed towards the body, which hinge arm projects downwardly beyond a lower edge of the first lid element and which is fixed with a lower end at an inner face of the second lid element so as to be pivotable around the second axis, which inner face is directed towards the body, wherein the distance between the lower edge of the first lid element and the second axis approximately corresponds to the distance between an upper edge of the second lid element and the second axis.

It thus becomes possible for the second axis around which the first lid element and the second lid element are pivoted relative to one another to deviate from the optical division between the first panel and the second panel. This is of particular interest in those cases where, optically, the first lid element is to comprise the same height as the second lid element and where the second axis is to be arranged eccentrically as a pivot axis between the first lid element and the second lid element.

In order to ensure a torque in every pivot position of the folding lid, which torque ensures that the folding lid is held in position, it is proposed that the lid stay comprises a housing which can be connected to the side wall of the body and in which the setting arm is supported so as to be pivotable around the third axis; that the setting arm comprises a setting contour which is formed as a curve around the third axis; that there is provided a setting slide which is guided linearly slidable in the housing and which is radially loaded by spring means to establish contact with the setting contour of the setting arm; and that the radial distance between the setting contour and the third axis in the region of contact between the setting slide and the setting contour decreases at least partially, starting from a first pivot position of the setting arm, which corresponds to the closed position of the folding lid, via an angular path of the setting arm to a second pivot position which corresponds to the open position of the folding lid.

By means of the setting contour and the setting slide, it is thus possible to generate a torque for each position of the folding lid, which torque is adjusted to the counter torque generated by the weight of the force of the folding lid.

By generating a tightening torque pulling the folding lid to the body via a short pivot path towards the pivot position of the setting arm, which pivot position corresponds to the closed position of the folding lid, it is proposed that the radial distance of the setting contour from the third axis in the region of contact between the setting slide and the setting contour, starting from a first pivot position of the setting arm, which corresponds to the closed position of the folding lid, via an angular path of the setting arm, to an intermediate position between the first pivot position and the second pivot position, is constant or increases.

The setting slide can be supported against the setting contour by a roller which is rotatably supported at the setting slide. In this way it is ensured that there are generated only slight friction forces between the setting slide and the setting contour. However, it is also conceivable for the setting slide to be in sliding contact with the setting contour.

To be able to vary the torque and to be able to adjust the lid stay to different folding lids, it is proposed to provide a supporting bearing which is held at variable distances from the third axis in the housing and that the spring means are supported on the one hand against the setting slide and against the supporting bearing on the other hand.

Simple means which hold the supporting bearing at a variable distance from the axis in the housing can be provided in that the supporting bearing is supported against a bearing face of an abutment which is supported in the housing so as to be rotatable around an axis of rotation, wherein the bearing face, in the circumferential direction, comprises a variable distance from the axis of rotation. The bearing face can be designed to be spiral-like.

As a rule, lids are pivotably secured to upper cabinet shelves by settable hinges which permit production inaccuracies to be compensated for. However, in the folding lid in accordance with the invention this would mean that also the articulation point of the setting arm at the second lid element would have to be adjusted in accordance with the settable hinge. To avoid such manual setting, it is possible to provide a length adjusting element which comprises a base element firmly connected to the second lid element and which, furthermore, comprises a sliding element which, if viewed in the closed position of the folding lid, is guided in the base element so as to be slidable relative thereto in the vertical direction between a first position arranged near the second axis and a second position arranged remote from the second axis and is loaded by spring means towards the first position.

The length adjusting element ensures that, in the closed position of the folding lid, the spring means apply a vertically downwardly directed force to the second lid element, so that there is generated a torque which pulls the folding lid to the body.

BRIEF DESCRIPTION OF THE DRAWING

A preferred embodiment will be explained in greater detail below with reference to the drawings wherein.

DETAILED DESCRIPTION OF THE INVENTION

Figure 1:
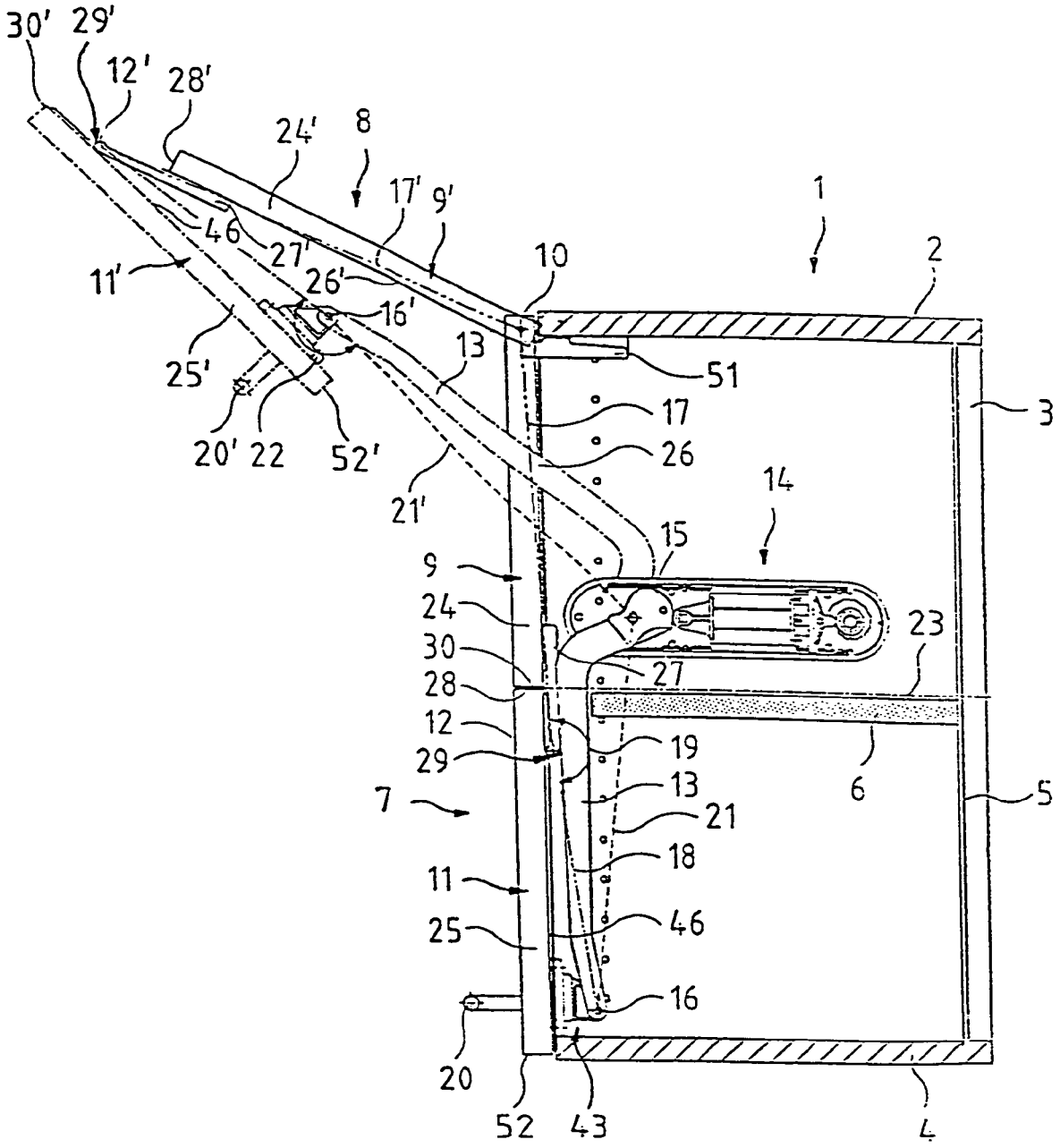
FIG. 1 is a cross-section through a cabinet with an inventive folding lid, with the folding lid being shown in its open position on the one hand and in its closed position on the other hand.

FIG. 1 shows a body 1 of a cabinet which comprises an upper cabinet shelf 2, a side wall 3, a lower cabinet shelf 4, a rear wall 5 and an inserted shelf 6. Furthermore, the body 1 comprises an aperture 7 which can be closed by a folding lid 8.

The folding lid 8 comprises a first lid element 9 which is secured to upper cabinet shelf 2 so as to be pivotable around a horizontally arranged first axis 10. Furthermore, the folding lid 8 comprises a second lid element 11 which is connected to the first lid element 9 so as to be pivotable around a horizontally arranged second axis 12. The folding lid 8 can be set between a closed position, in which the first lid element has been given the reference number 9 and the second lid element the reference number 11, and an open position in which the first lid element has been given the reference number 9' and the second lid element the reference number 11'. In the following description, in the closed position of the folding lid 8, all further movable parts have been given reference numbers without an apostrophe and in the open position of the folding lid 8 reference numbers with an apostrophe.

The setting arm 13 of a lid stay 14 is fixed to the side wall 3 so as to be pivotable around a horizontally arranged third axis 15. Furthermore, the setting arm 13 is connected to the second lid element 11 so as to be pivotable around a horizontally arranged fourth axis. The mode of operation of the lid stay 14 will be explained in detail with reference to FIG. 2.

In the pivot position of the setting arm 13 which corresponds to the closed position of the folding lid 8, the effective lever arm 17, between the first axis 10 and the second axis 12, and the effective lever arm 18, between the second axis 12 and the fourth axis 16, enclose an angle 19 which is directed towards the body 1 and which is slightly smaller than 180°, so that the dead center is not passed in this position. It is thus possible, by means of a handle 20, which is arranged only slightly above the fourth axis 16, for the folding lid 8 to be lifted off the body 1 and transferred into the open position.

In the pivot position of the setting arm 13', which corresponds to the open position of the folding lid 8, the effective lever arm 18, between the first axis 12' and the fourth axis 16', and the effective lever arm 21', between the fourth axis 16' and the third axis 15, enclose an angle 22 which is directed away from the first lid element 9' and which is slightly smaller than 180°. In this position, the setting arm 13' and the second lid element 11' are in an aligned position relative to one another and have passed the upper dead center of the rotary joint drive formed by the effective lever arms. The gravity of the folding lid 8 thus ensures that the setting arm 13' is loaded into a pivot position which corresponds to the open position of the folding lid 8, so that the folding lid 8 cannot automatically move into the closed position. To achieve this, it is necessary to pull the handle 20' in order to move the folding lid 8 out of the upper dead center position.

In order to ensure that the first lid element 9', in the open position of the folding lid 8, does not upwardly project too far beyond the upper cabinet shelf 2 and to ensure that the second lid element 11' is folded as closely as possible to the first lid element 9', the first axis 10, the second axis 12 (12') and the fourth axis 16 (16') are arranged relative to one another in such a way that the effective lever arm 17 (17') between the first axis 10 and the second axis 12 (12') is longer than the effective lever arm 18 (18') between the second axis 12 (12') and the fourth axis 16 (16').

In addition, it should be ensured that the inserted shelf 6 is arranged approximately at the level of an imaginary horizontally extending central plane 23 of the body 1. For this purpose, the third axis 15 is arranged above the central plane 23.

As the handle 20, if viewed in the closed position of the folding lid 8, should be provided as low as possible at the second lid element 11, so that frame lid elements can also be used which consist of a frame element embracing a pane of glass, the fourth axis 16, too, has to be provided as low as possible at the second lid element 11. For this purpose it has to be ensured that the effective lever arm 17 between the first axis 10 and the second axis 12 is longer than the distance between the second axis 12 and a lower edge 52 of the second lid element 11, which lower edge 52 is arranged remote from the first lid element 9.

In order to ensure, optically, a symmetrical division of the folding lid 8, in spite of the different lengths of the effective levers 17, 18, the first lid element comprises a first panel 24 and the second lid element comprises a second panel 25 which both, if viewed in the closed position of the folding lid 8, comprise the same height. At an inner surface 26 of the lid element 9, which inner surface 26 faces the body 1, there is secured a hinge arm 27 which projects downwardly beyond a lower edge 28 of the first panel 24 and is secured with a lower end 29, so as to be articulatable around the second axis 12, at an inner face 46 of the second panel 25, which inner face is directed towards the body 1. The distance between the lower edge 28 and the second axis 12 approximately corresponds to the distance between an upper edge 30 of the second panel 25 and the second axis 12.

With a standard body height of 720 mm, the third axis 15 is preferably removed by approximately 289 mm from the inner face of the upper cabinet shelf 2 and, if the folding lid is closed, by approximately 78 mm from the inner face 26 of the first lid element 9. With a standard height of 600 mm, the above values amount to approximately 223 mm from the upper cabinet shelf 2 and 63 mm from the first lid element 9.

In the case of both standard heights, with the first panel 24 and the second panel 25 having identical heights, the second axis 12, with the folding lid 8, is offset downwardly by approx. 52 mm from the lower edge 28 of the first panel 24. The fourth axis 16 is removed from the inner surface 46 of the second lid element by 30 mm and from the surface of the lower cabinet shelf 4 by approx. 22 mm.

Figure 2:
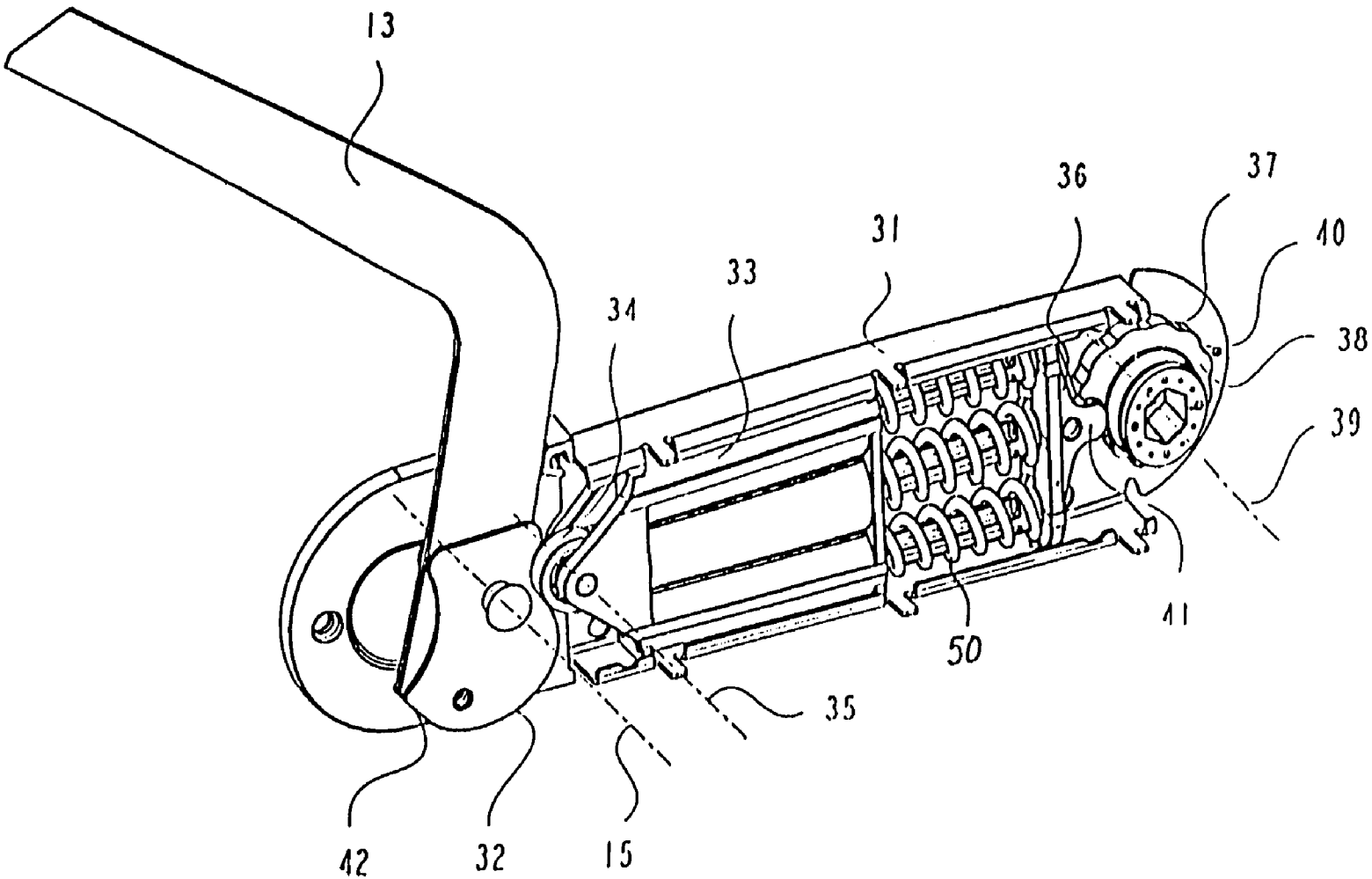
FIG. 2 is a perspective view of the lid stay.
Figure 3:
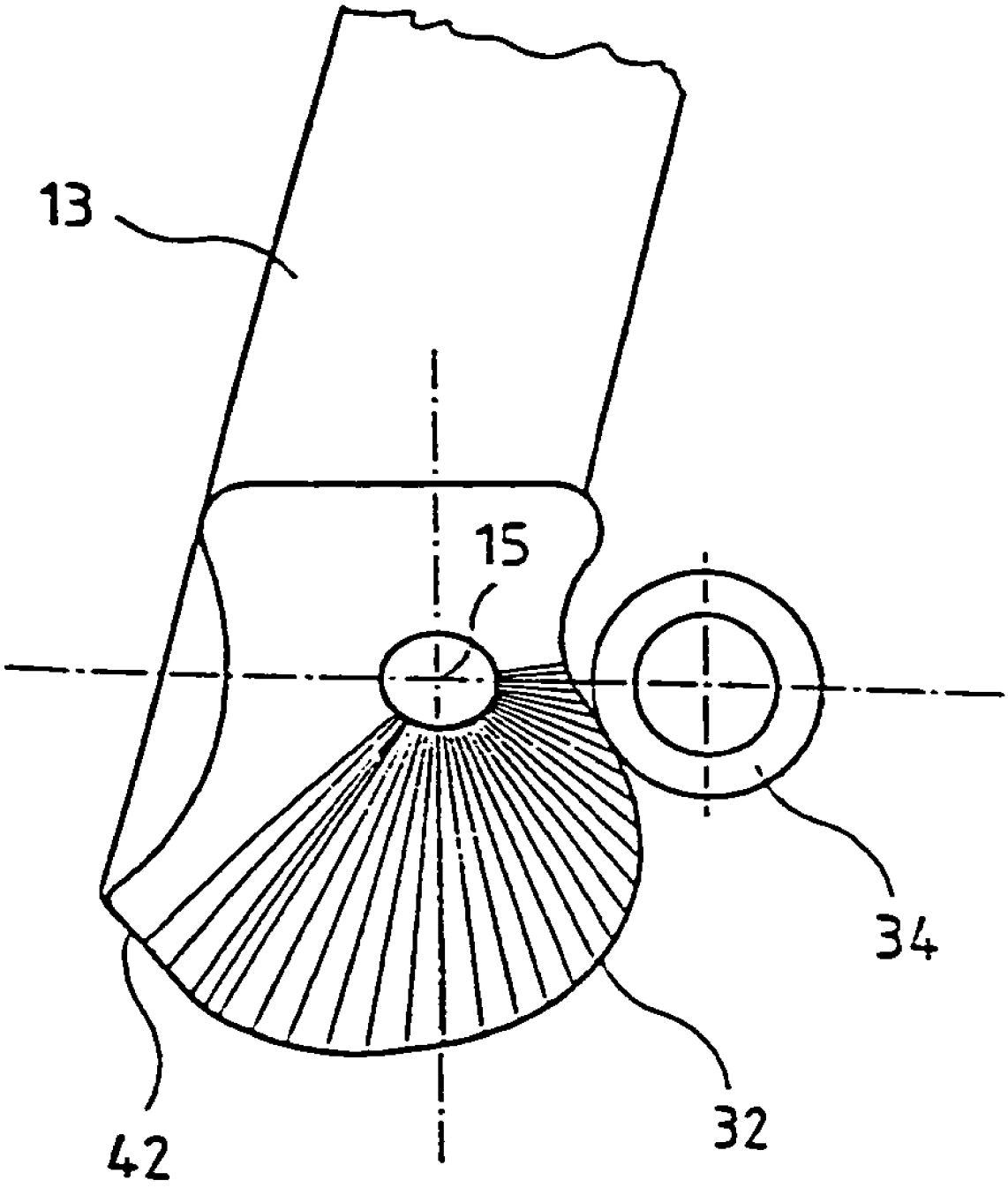
FIG. 3 is a plan view of the setting contour at the setting arm.

The lid stay 14 will be described below with reference to FIGS. 1, 2 and 3, with identical components having been given the same reference numbers.

The setting arm 13 is supported in a housing 31 of the lid stay 14 so as to be pivotable around the third axis 15, with the housing 31 being firmly connected to the side wall 3 of the body 1. The setting arm 13 comprises a setting contour 32 which is formed as a curve around the third axis 15.

A setting slide 33 is linearly displaceably guided in the housing 31. The setting slide 33 comprises a roller 34 which is supported at the setting slide 33 so as to be rotatable around an axis of rotation 35 which extends parallel to the third axis 15. The roller 34 is in contact with the setting contour 32 by means of an outer circumferential face. Springs 50 load the setting slide 33 and thus the roller 34 against the setting contour 32. The spring means are supported against the setting slide 33 on the one hand and, on the other hand, against a supporting bearing 36 which is linearly displaceably supported in the housing 31. The supporting bearing 36 is supported against a, bearing face 37 of an abutment 38, with the abutment 38 being supported in the housing 31 so as to be rotatable around an axis of rotation 39 and with the bearing face 37 comprising a variable distance from the axis of rotation 39 of the abutment 38, so that the supporting bearing 36 is held at a variable distance from the third axis 15 in the housing 31. The bearing face 37 is shaped so as to be spiral-like and comprises radial engagement indentations which are engaged by an engagement lug 41 of the supporting bearing 36 to prevent the abutment 38 from being rotated unintentionally.

The setting contour 32 of the setting arm 13 is designed in such a way that the radial distance of the setting contour 32 from the third axis 15 in the region of contact between the setting slide 33, i.e. the roller 34, and the setting contour 32 increases via a pivot path, starting from a first pivot position of the setting arm 13, which corresponds to the open position of the folding lid 8, via an angular path of the setting arm 13 as far as an intermediate position of the setting arm 13, which corresponds to a position of the folding lid 8 near the closed position between the open position and the closed position. It is thus ensured that the setting arm 13 is force-loaded via the greatest angular distance with a force which generates a torque towards the upper position which corresponds to the open position of the folding lid 8. Along the angular path, starting from the intermediate position as far as the pivot position which corresponds to the closed position of the folding lid 8, the setting contour comprises a flattened portion across which the radial distance from the third axis 15 decreases. Via said pivot path, there is thus generated a torque which loads the setting arm 13 into the pivot position which corresponds to the closed position of the folding lid 8. The setting contour 32 is designed in such a way that, in every pivot position of the setting arm 13, the torque as generated corresponds to the counter torque generated by the force of the weight of the folding lid 8 as a whole, so that the folding lid 8 is held in place in every position between the open position and the closed position.

Figure 4:
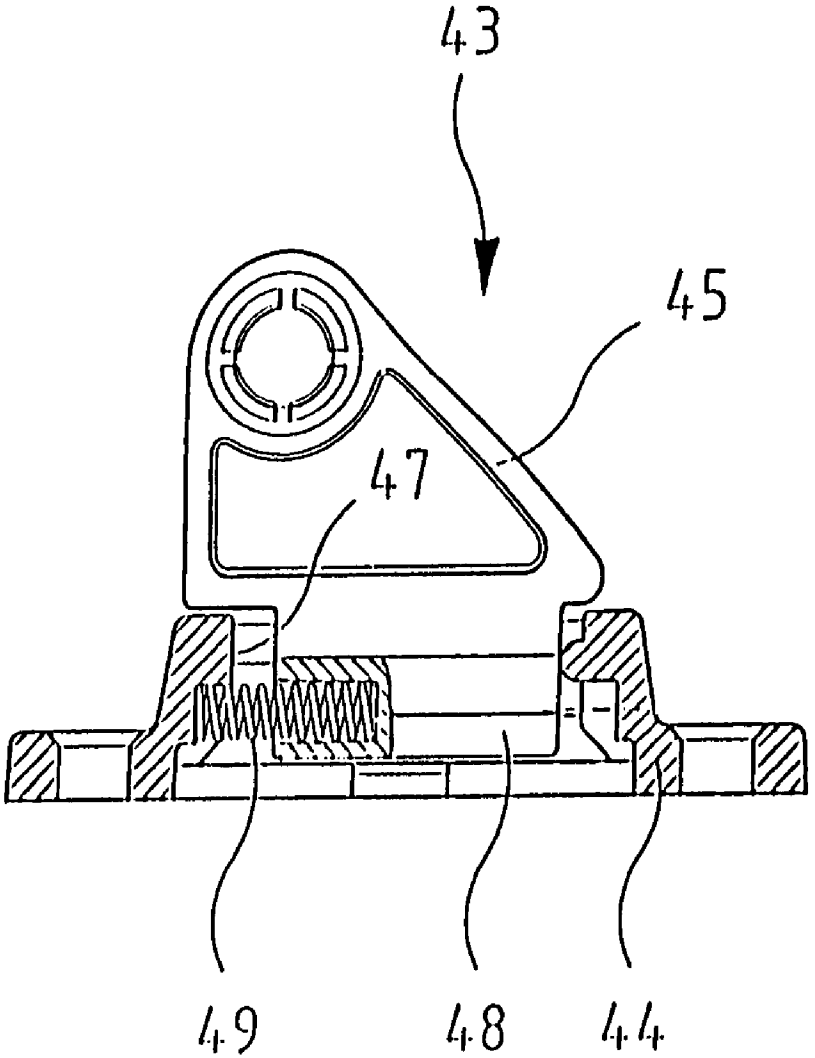
FIG. 4 shows a partial section through a length adjusting element.

FIG. 4 shows a length adjusting element which is provided for pivotably fixing the setting arm 13 at the second lid element 11. The length adjusting element 43 comprises a base element 44 and a sliding element 45. The base element 44 is firmly fitted at the inner surface 46 of the second panel 25 in the region of the lower edge of the second panel 25. The base element 44 comprises a guiding groove 47 which, if viewed in the closed position of the folding lid 8, is arranged vertically and in which the sliding element 45 is linearly displaceably guided by means of a guiding projection 48 between a first and a second position. In the direction of adjustment of the sliding element 45, a spring 49 is supported at one end of the guiding groove 47 against the base element 44 on the one hand and against the projection 48 of the sliding element 45 on the other hand, so that the sliding element 45 is loaded towards the first position.

The length adjusting element 43 serves to compensate for production inaccuracies as well as changes in respect of the distance between the fourth axis 16 and the first axis 10. Changes can occur as a result of the first lid element 9 being pivotably secured to the upper cabinet shelf 2 by means of an adjustable hinge 51. It is thus avoided that, when setting the hinge 51, it is also necessary to set the articulation point of the setting arm 13 at the second lid element 11.

Furthermore, as a result of the spring 49, a spring force acts vertically downwardly on the second lid element 11 when the folding lid 8 is in its closed position. There is thus generated a moment by which the folding lid 8 is drawn as far as the body 1.

The invention claimed is:

1. A combination of a folding lid and a cabinet to which the folding lid is attached so as to open upwardly and be set between an open position and a closed position, comprising:

a first lid element (9) which can be fixed at an upper cabinet shelf (2) of the cabinet so as to be pivotable around a horizontally arranged first axis (10);

a second lid element (11) which is connected to the first lid element (9) so as to be pivotable around a second axis (12) extending parallel to the first axis (10); and a lid stay (14) with a setting arm (13) which is fixed to a side wall (3) of the cabinet so as to be pivotable around a third axis (15) extending parallel to the first axis (10) and which is connected to the second lid element (11) so as to be pivotable around a fourth axis (16) extending parallel to the first axis (10), wherein the setting arm (13) comprises a spring-loaded setting contour (32) which is formed as a curve around the third axis (15), wherein the radial distance between the setting contour (32) and the third axis (15) decreases at least partially, starting from a first pivot position of the setting arm (13), which corresponds to the closed position of the folding lid (8), via an angular path of the setting arm (13) to a second pivot position which corresponds to the open position of the folding lid (8), wherein the torque generated by the setting contour for every pivot position over said angular path corresponds to the counter torque generated by the force of the weight of the folding lid (8) as a whole, so that the setting arm (13) is torque-loaded towards the open position along at least a part of the pivot range from the closed position to the open position of the folding lid (8), and wherein the magnitude of the torque in each pivot position of the folding lid (8), between and including the first and second pivot positions, is such that the folding lid (8) is held in place.

2. A folding lid according to claim 1, wherein the distance between the first axis (10) and the second axis (12) is greater than the distance between the second axis (12) and the fourth axis (16) and wherein in the closed position of the folding lid (8), the third axis (15) is arranged above an imaginary horizontal central axis (23) of the folding lid (8).

3. A folding lid according to claim 2, wherein the distance between the first axis (10) and the second axis (12) is greater than the distance between the second axis (12) and a lower edge (52) of the second lid element (11) which is displaced from the first lid element (9).

4. A folding lid according to claim 1, wherein, in the open position of the folding lid (8'), the fourth axis (16') is arranged in the direction towards the first lid element (9') so as to be offset relative to a plane which contains the second axis (12') and the third axis (15).

5. A folding lid according to claim 1, wherein the first lid element (9) comprises a first panel (24) and that the second lid element (11) comprises a second panel (25), wherein the first panel (24) and the second panel (25) comprise identical heights if viewed in the closed position of the folding lid (8);

wherein there is provided at least one hinge arm (27) which is secured to an inner face (26) of the first lid element (9), which inner face (26) is directed towards the body (1), which hinge arm (27) projects downwardly beyond a lower edge (28) of the first lid element (9) and which is fixed with a lower end (29) at an inner face (46) of the second lid element (11) so as to be pivotable around the second axis (12), which inner face (46) is directed towards the body (1), and wherein the distance between the lower edge (28) of the first lid element (9) and the second axis (12) approximately corresponds to the distance between an upper edge (30) of the second lid element (11) and the second axis (12).

6. A folding lid according to claim 1, wherein there is provided a length adjusting element (43) which comprises a base element (44) firmly connected to the second lid element (11) and which, furthermore, comprises a sliding element (45) which, if viewed in the closed position of the folding lid (8), is guided in the base element (44) so as to be slidable relative thereto in the vertical direction between a first position arranged near the second axis (12) and a second position arranged remote from the second axis (12) and is loaded by spring means (49) against to the first position.

7. A folding lid according to claim 1, wherein the lid stay (14) comprises a housing (31) which can be connected to the side wall (3) of the body (1) and the setting arm (13) is supported so as to be pivotable around the third axis (15); and wherein there is provided a setting slide (33) which is guided linearly slidable in the housing (31) and which is radially loaded by spring means in contact with the setting contour (32) of the setting arm (13).

8. A folding lid according to claim 7, wherein the radial distance of the setting contour from the third axis (15) in the region of contact between the setting slide (33) and the setting contour (32), starting from a first pivot position of the setting arm (13), which corresponds to the closed position of the folding lid (8), via an angular path of the setting arm (13), to the intermediate position between the first pivot position and the second pivot position, is constant or increases.

9. A folding lid according to claim 7, wherein the setting slide (33) is supported against the setting contour (32) by means of a roller (34) which is rotatably supported at the setting slide (33).

10. A folding lid according to claim 7, wherein there is provided a supporting bearing (36) which is held at a variable distance relative to the third axis (15) in the housing (31), and wherein the spring means are supported against the setting slide (33) on the one hand and against the supporting bearing (36) on the other hand.

11. A folding lid according to claim 10, wherein the supporting bearing (36) is supported against a bearing face (37) of an abutment (38) which is rotatably supported around an axis of rotation (39) in the housing (31), wherein, in the circumferential direction, the bearing face (37) comprises a variable distance from the axis of rotation (39).

12. A folding lid according to claim 11, wherein the bearing face (37) has a spiral shape.

* * * * *